US006012790A

United States Patent [19]

Thomas et al.

[11] Patent Number: 6,012,790

[45] Date of Patent: Jan. 11, 2000

[54] COLLAPSIBLE, MULTI-FUNCTIONAL KIOSK

[75] Inventors: Edwin J. Thomas; Eric D. Anderson, both of Akron, Ohio

[73] Assignee: Steere Enterprises, Inc., Tallmadge, Ohio

[21] Appl. No.: 08/949,561

[22] Filed: Oct. 14, 1997

[51] Int. Cl.[7] ..... A47B 43/00

[52] U.S. Cl. ..... 312/257.1; 40/312; 312/265.5

[58] Field of Search ..... 312/114, 116, 312/236, 257.1, 265.5, 265.3, 265.4, 265.6, 102; 40/312, 313, 765, 766, 649

[56] References Cited

U.S. PATENT DOCUMENTS

| | | | |
|---|---|---|---|
| 2,360,451 | 10/1944 | Stone | 312/265.5 |
| 2,831,610 | 4/1958 | Dennie | 222/105 |
| 2,846,080 | 8/1958 | Freeman | 211/148 |
| 3,704,925 | 12/1972 | Scott | 312/228 |
| 3,860,305 | 1/1975 | Bergman | 312/114 |
| 3,868,153 | 2/1975 | Sholtes | 312/236 |
| 4,153,313 | 5/1979 | Propst | 312/211 |
| 4,629,096 | 12/1986 | Schroer et al. | 312/236 X |
| 4,782,972 | 11/1988 | Wenkman et al. | 312/257.1 X |
| 5,123,720 | 6/1992 | Blomster et al. | 312/257.1 X |
| 5,382,087 | 1/1995 | Pouch | 312/265.5 X |
| 5,448,844 | 9/1995 | Miller, Jr. et al. | 40/312 X |
| 5,527,103 | 6/1996 | Pittman | 312/257.1 X |
| 5,528,810 | 6/1996 | Eddy et al. | 29/401.1 |
| 5,553,751 | 9/1996 | Mowers | 222/183 |
| 5,573,142 | 11/1996 | Morellato et al. | 222/129.1 |
| 5,645,331 | 7/1997 | Eddy et al. | 312/265.6 X |
| 5,647,648 | 7/1997 | Duesler | 312/108 |

*Primary Examiner*—Peter M. Cuomo
*Assistant Examiner*—Stephen Vu
*Attorney, Agent, or Firm*—Renner, Kenner, Greive Bobak, Taylor & Weber

[57] ABSTRACT

A multi-functional kiosk embodying the concepts of the present invention utilizes a polygonal base member and a plurality of frame members. First interlocking means releasably secure the frame members to the polygonal base member, and second interlocking means releasably secure the frame members to each other. A hollow, central cavity is defined by the connection of the frame members to the polygonal base as well as to each other. A refreshment dispenser is capable of being supported within the hollow, central cavity of the kiosk, and a trash receptacle is also capable of being supported within the hollow, central cavity. An aperture penetrates at least one of the frame members to provide access to the refreshment dispenser and the trash receptacle. Panel portions are provided on the exterior of selected frame members to present advertising displays, and a roof member is releasably secured to the connected frame members.

12 Claims, 16 Drawing Sheets

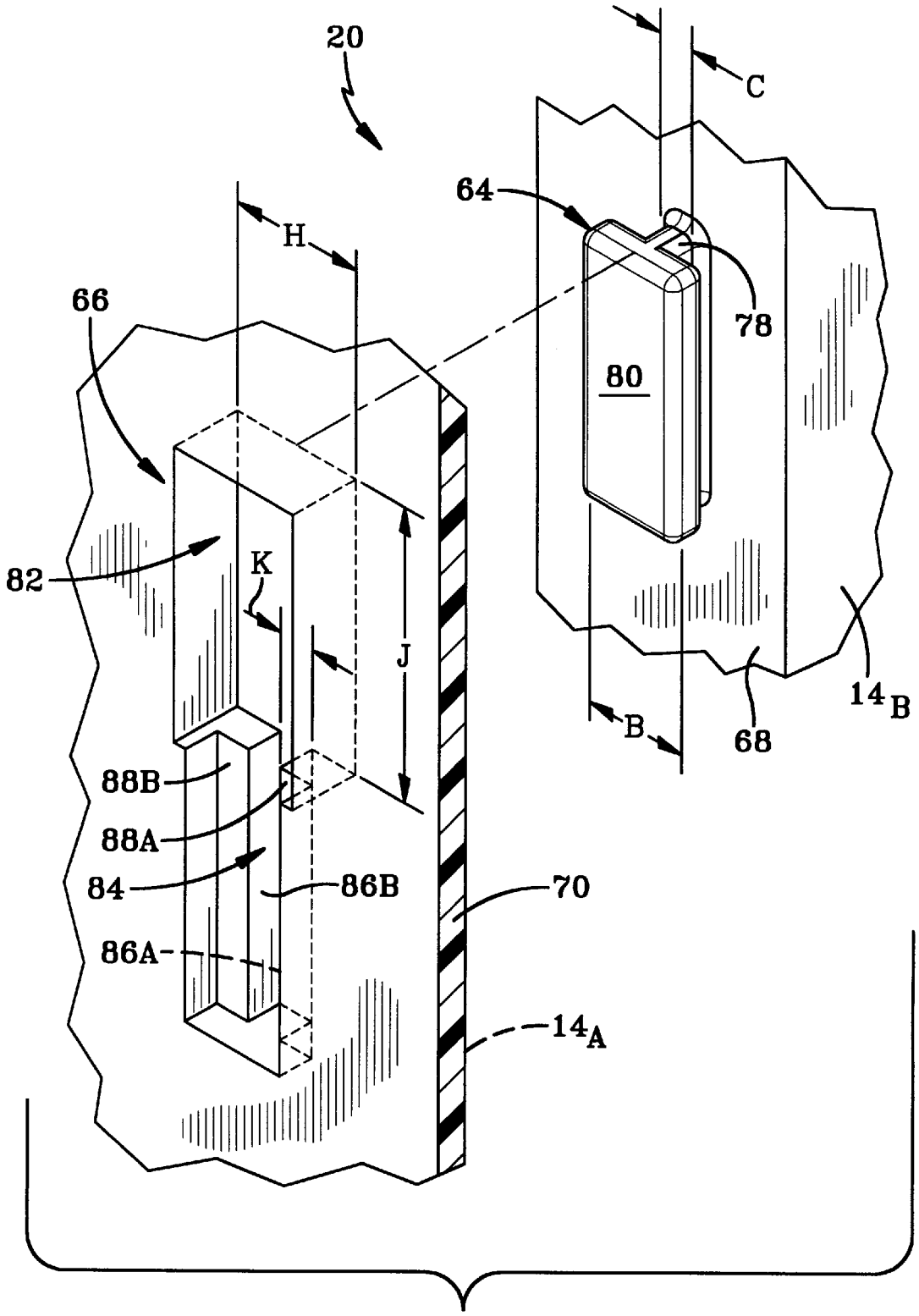
FIG-9A1

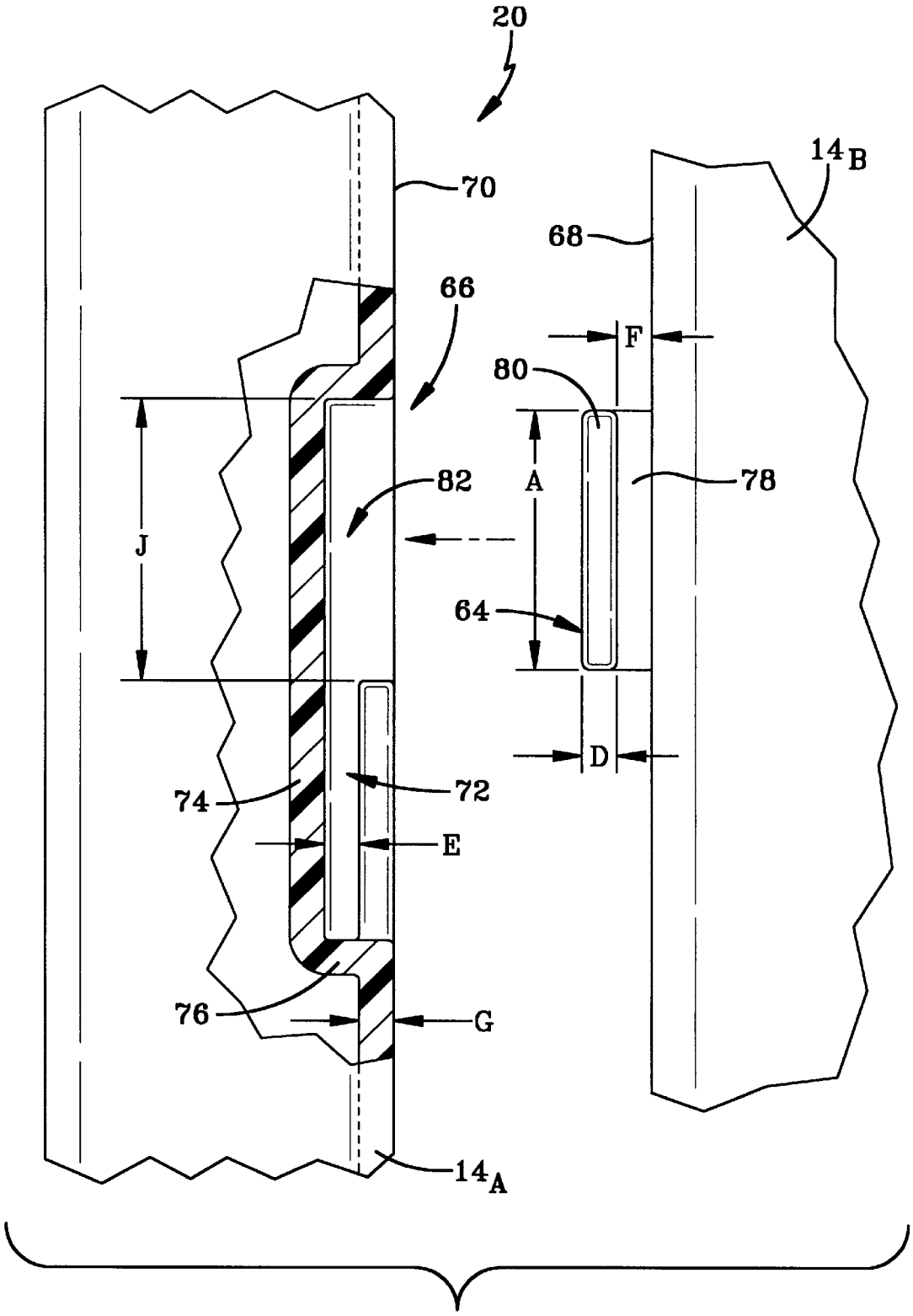
FIG-9A2

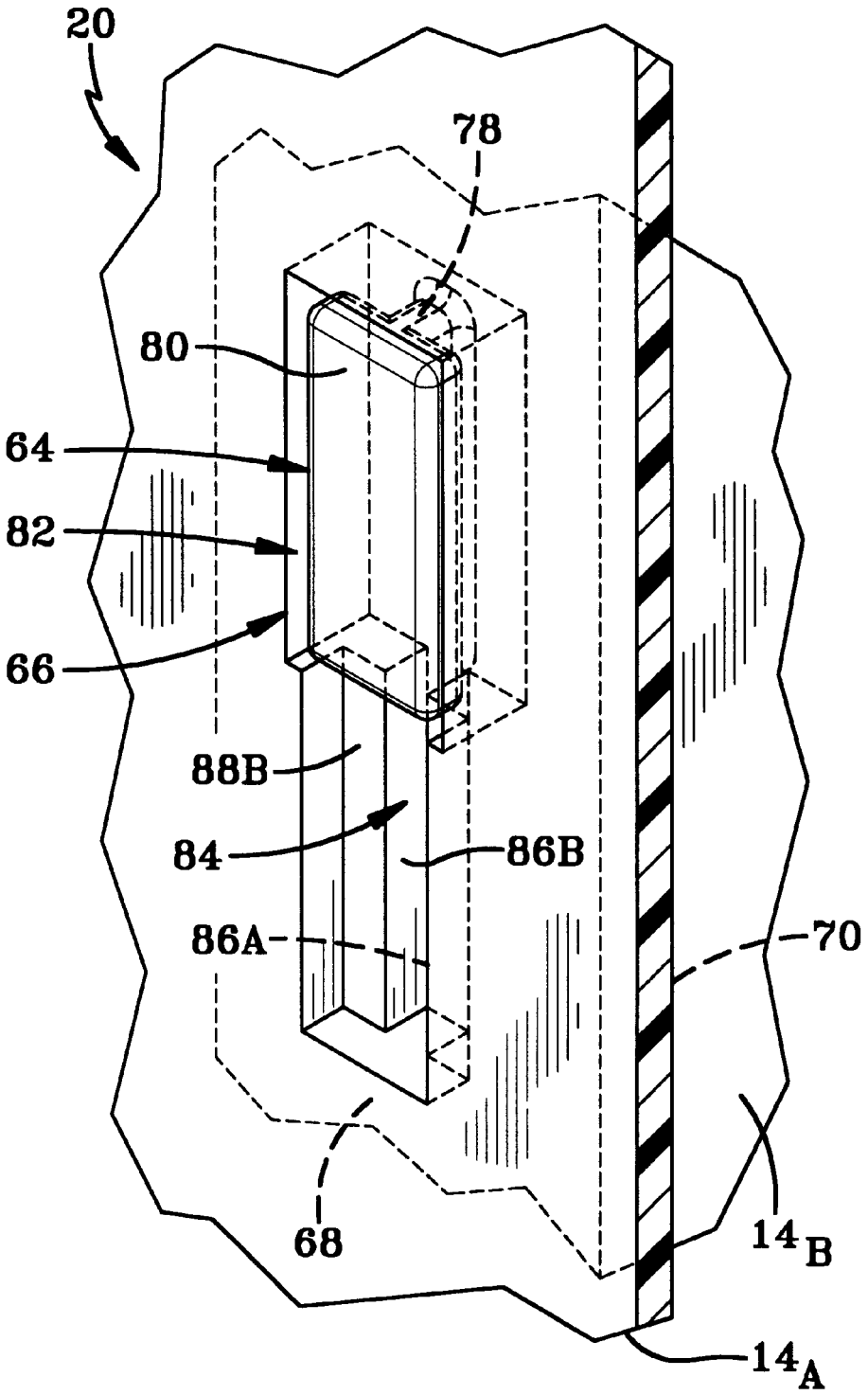
FIG-9B1

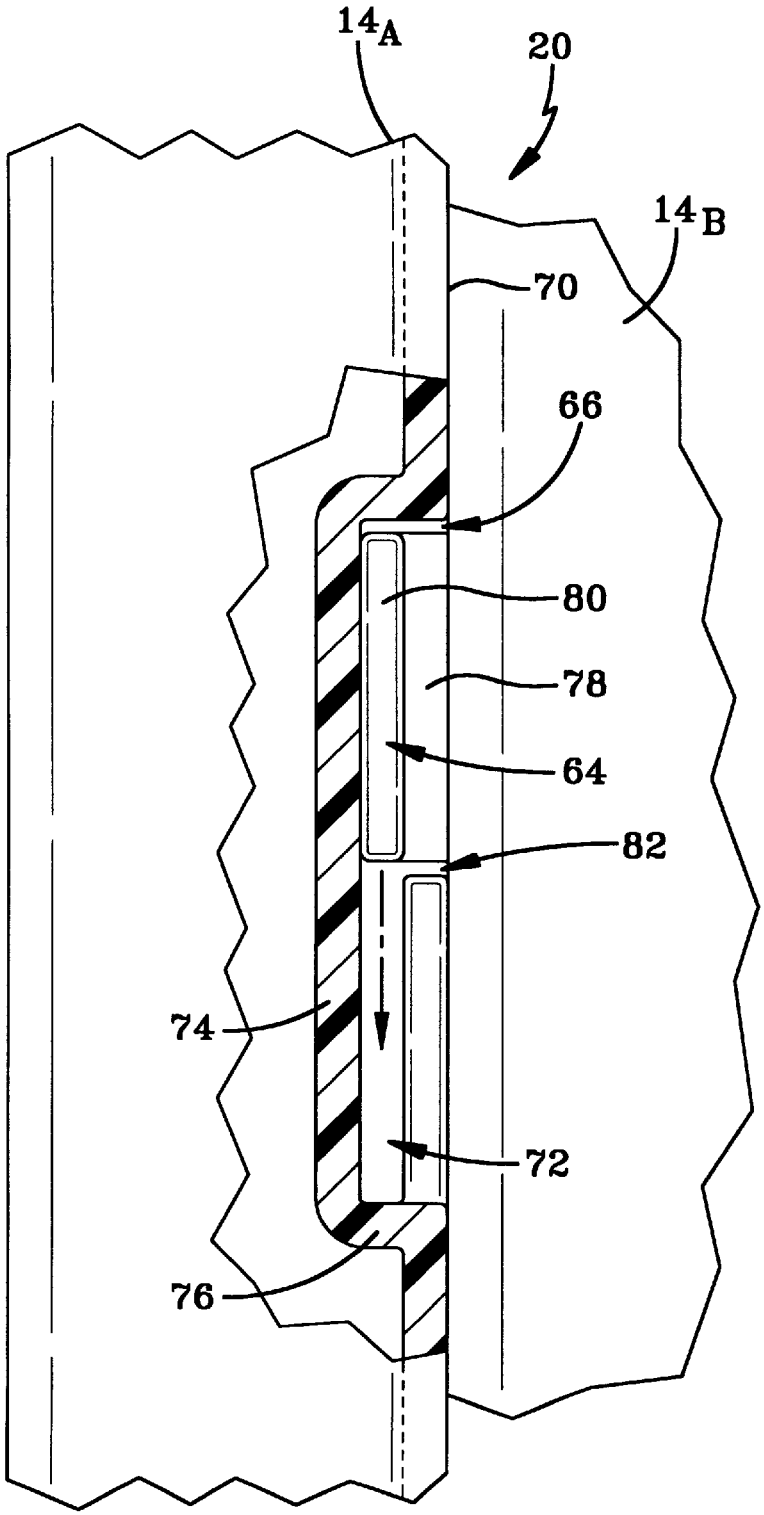
FIG-9B2

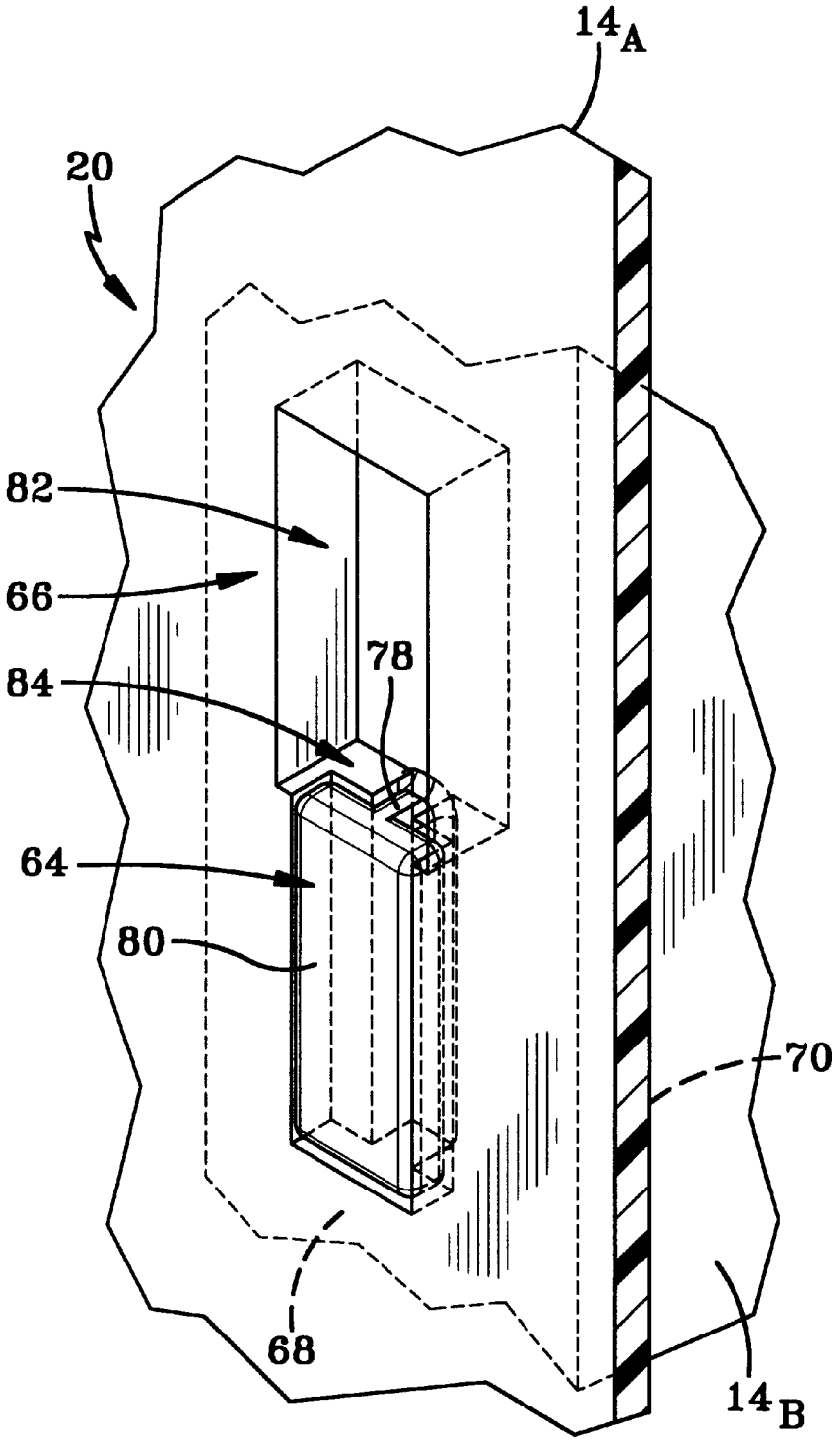
FIG-9C1

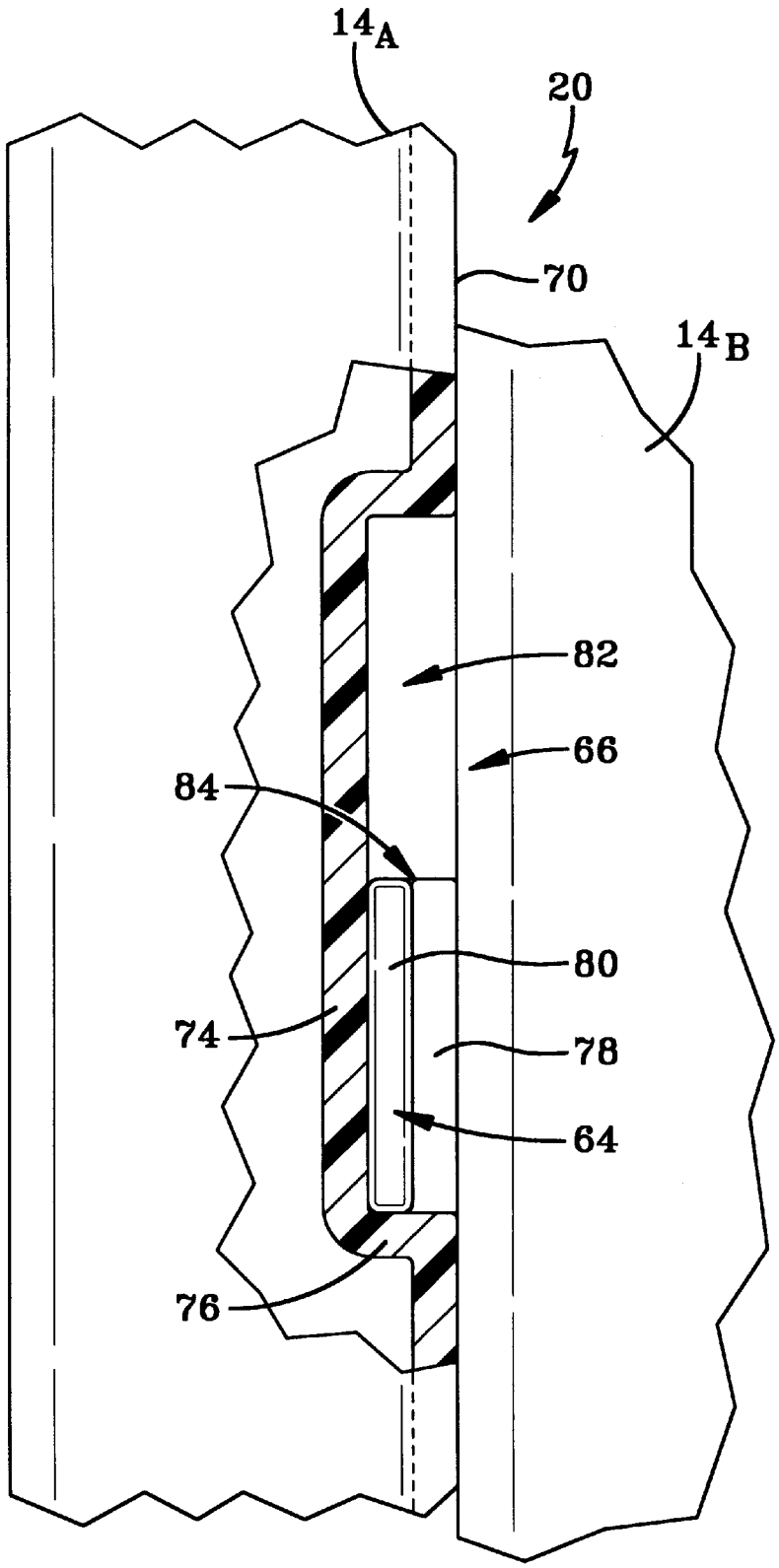
FIG-9C2

COLLAPSIBLE, MULTI-FUNCTIONAL KIOSK

TECHNICAL FIELD

The present invention relates generally to a multi-functional kiosk. More particularly, the present invention relates to a refreshment-dispensing, trash-receiving, advertising-displaying kiosk. Specifically, the present invention relates to a multi-functional kiosk that is quickly and easily disassembled for storage as well as quickly and easily assembled—neither assembly nor disassembly requiring tools.

BACKGROUND OF THE INVENTION

When major events—and particularly outdoor events—such as golf tournaments, air-shows, state and county fairs or the like are conducted, thousands of people gather to wander over a generally defined space. Such events are normally scheduled during the warmer months—with fingers crossed that the weather will cooperate during the term of the event. When the weather does cooperate, the thronging attendees become thirsty, and the sponsor(s) of the event try to provide some means by which the attendees can slake their thirst.

Refreshment stands, or dispensers for thirst-quenching drinks, are normally placed at selected locations within the defined space where spectators, and even participants, are gathered, and trash receptacles are preferably located in relatively close proximity to such refreshment facilities. Bottled water stands exemplify the present state of the art for refreshment dispensers utilized at such events, but such devices are typically incapable of being readily disassembled for moving and storage. As such, the prior art refreshment dispensers are not only sufficiently heavy to be inconvenient for one person to load onto, or from, a vehicle for transportation but they can only be stored in their erected configuration. The prior known refreshment dispenser disclosed in U.S. Pat. No. 3,882,305 is directed to a dispenser that can be shipped and then erected, but the erection procedure is sufficiently complicated that the assembly and/or disassembly procedure can not be readily performed with ease and efficiency by one person and without tools.

SUMMARY OF THE INVENTION

It is, therefore, a primary object of the present invention to provide a novel, multi-functional kiosk.

It is another object of the present invention to provide a kiosk, as above, that can be readily and efficiently assembled and/or disassembled by one person without the need for tools.

It is a further object of the present invention to provide a kiosk, as above, that is not only capable of incorporating a refreshment dispenser but also a trash receptacle.

It is still another object of the present invention to provide a kiosk, as above, that permits the facile presentation of advertising displays, or the like.

It is yet another object of the present invention to provide kiosk, as above, that has high impact resistance to preclude being defaced either by careless handling or by rowdyism.

These and other objects of the invention, as well as the advantages thereof over existing and prior art forms, which will be apparent in view of the following detailed specification, are accomplished by means hereinafter described and claimed.

In general, a multi-functional kiosk embodying the concepts of the present invention utilizes a polygonal base member and a plurality of frame members supported from the base member. A first interlocking structure releasably secures selected frame members to the polygonal base member, and a second interlocking structure releasably secures the frame members to each other. A hollow, central cavity is defined by the connection of the frame members to the base member as well as to each other.

A refreshment dispenser may be supported within the hollow, central cavity of the kiosk, and a trash receptacle is also supported within the hollow, central cavity. An aperture penetrates at least one of the frame members to provide access to the refreshment dispenser as well as to the trash receptacle.

Panel portions are provided on the exterior of selected frame members to present advertising displays, and a roof member is releasably secured to the connected frame members.

To acquaint persons skilled in the arts most closely related to the present invention, one preferred embodiment of a multi-functional kiosk that illustrates a best mode now contemplated for putting the invention into practice is described herein by, and with reference to, the annexed drawings that form a part of the specification. The exemplary multi-functional kiosk is described in detail without attempting to show all of the various forms and modification in which the invention might be embodied. As such, the embodiment shown and described herein is illustrative, and as will become apparent to those skilled in these arts can be modified in numerous ways within the spirit and scope of the invention; the invention being measured by the appended claims and not by the details of the specification.

Figure 1:
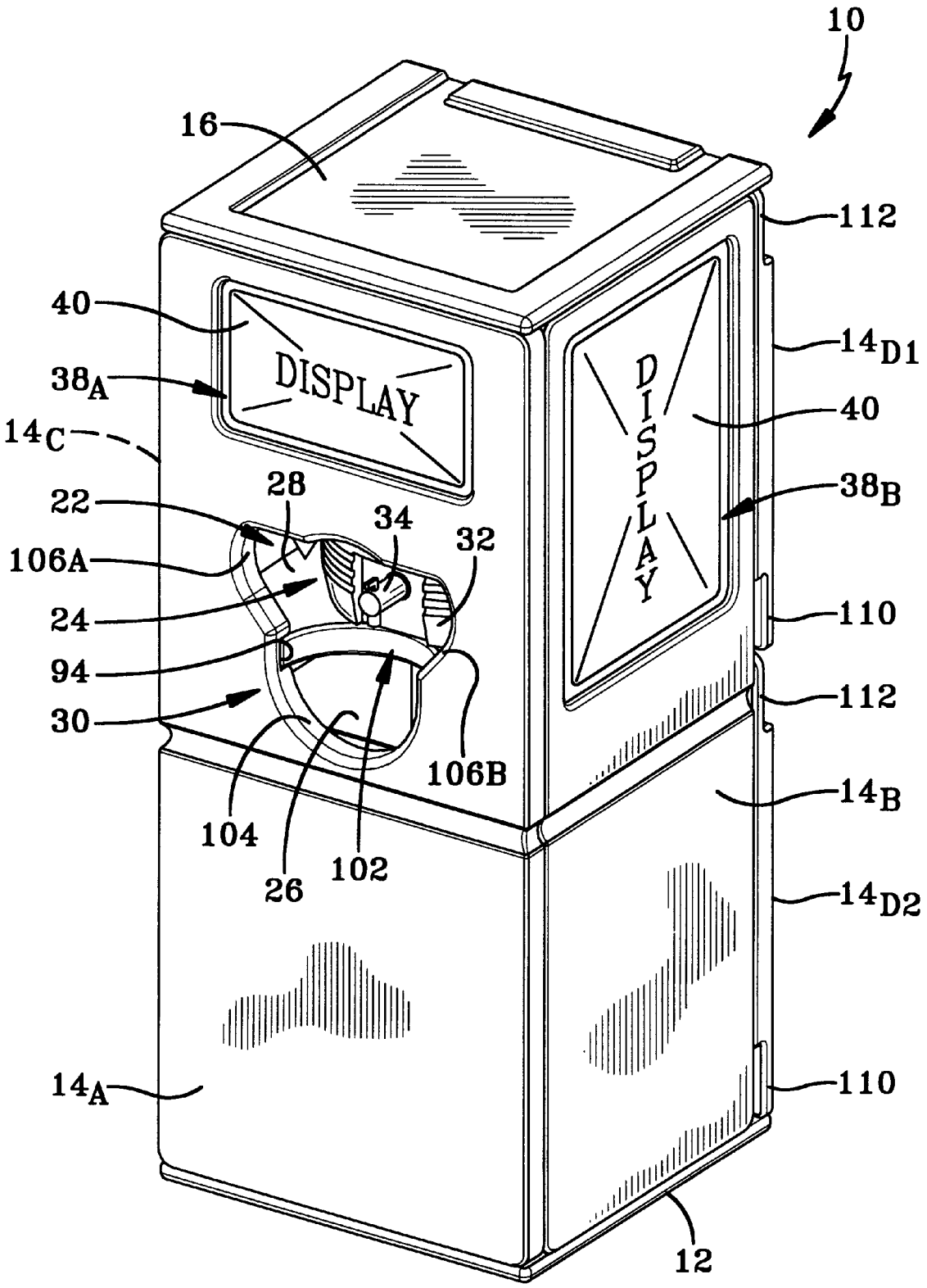
FIG. 1 is a perspective view of an erected, collapsible, multi-functional kiosk embodying the concepts of the present invention—the perspective providing a view of the front, one side and the top of the kiosk.
Figure 8:
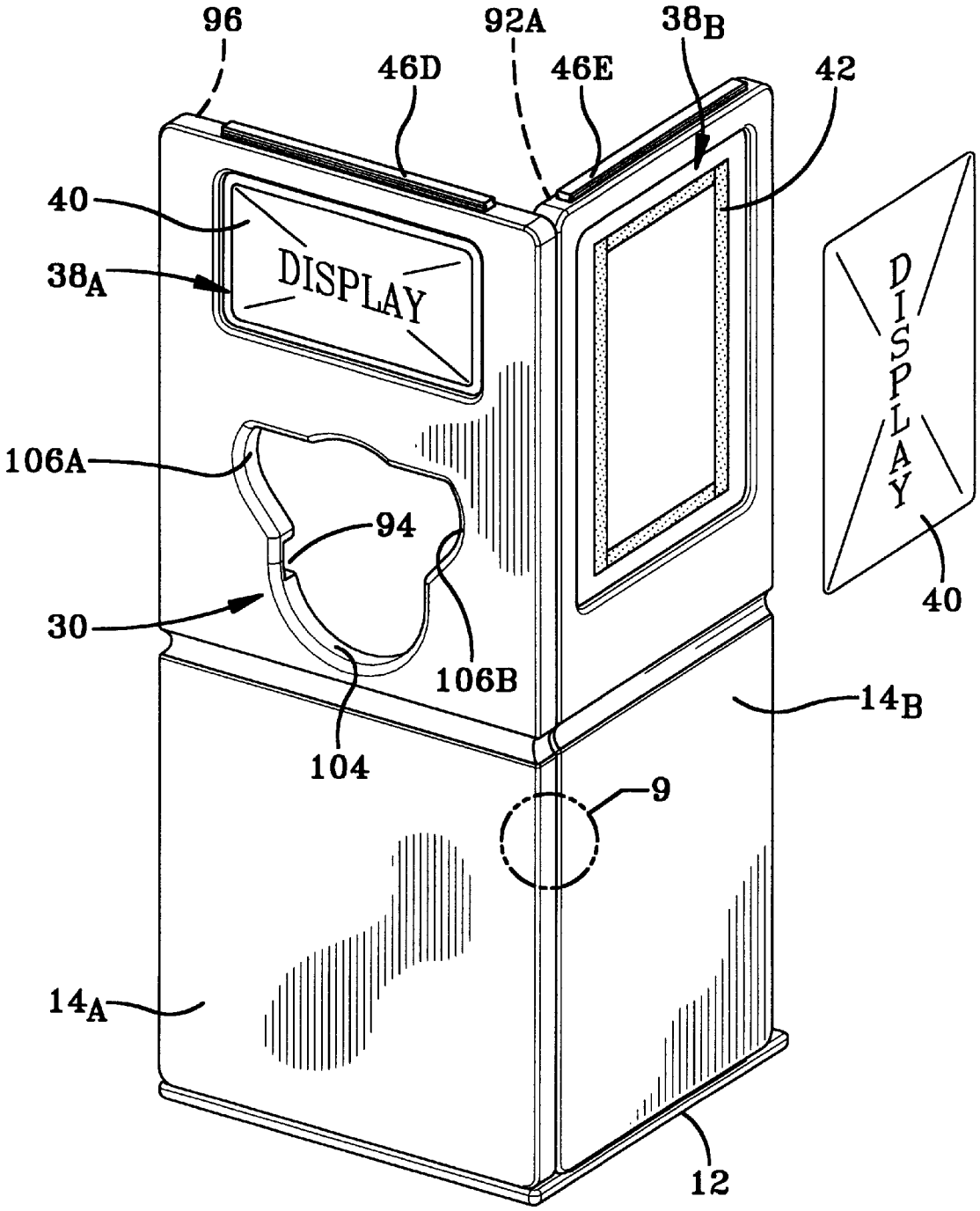
FIG. 8 is a perspective view similar to FIG. 6, but depicting the second step in effecting assembly of the kiosk—i.e.: a side frame member has been secured to both the frontal frame member and the polygonal base member.
Figure 10:
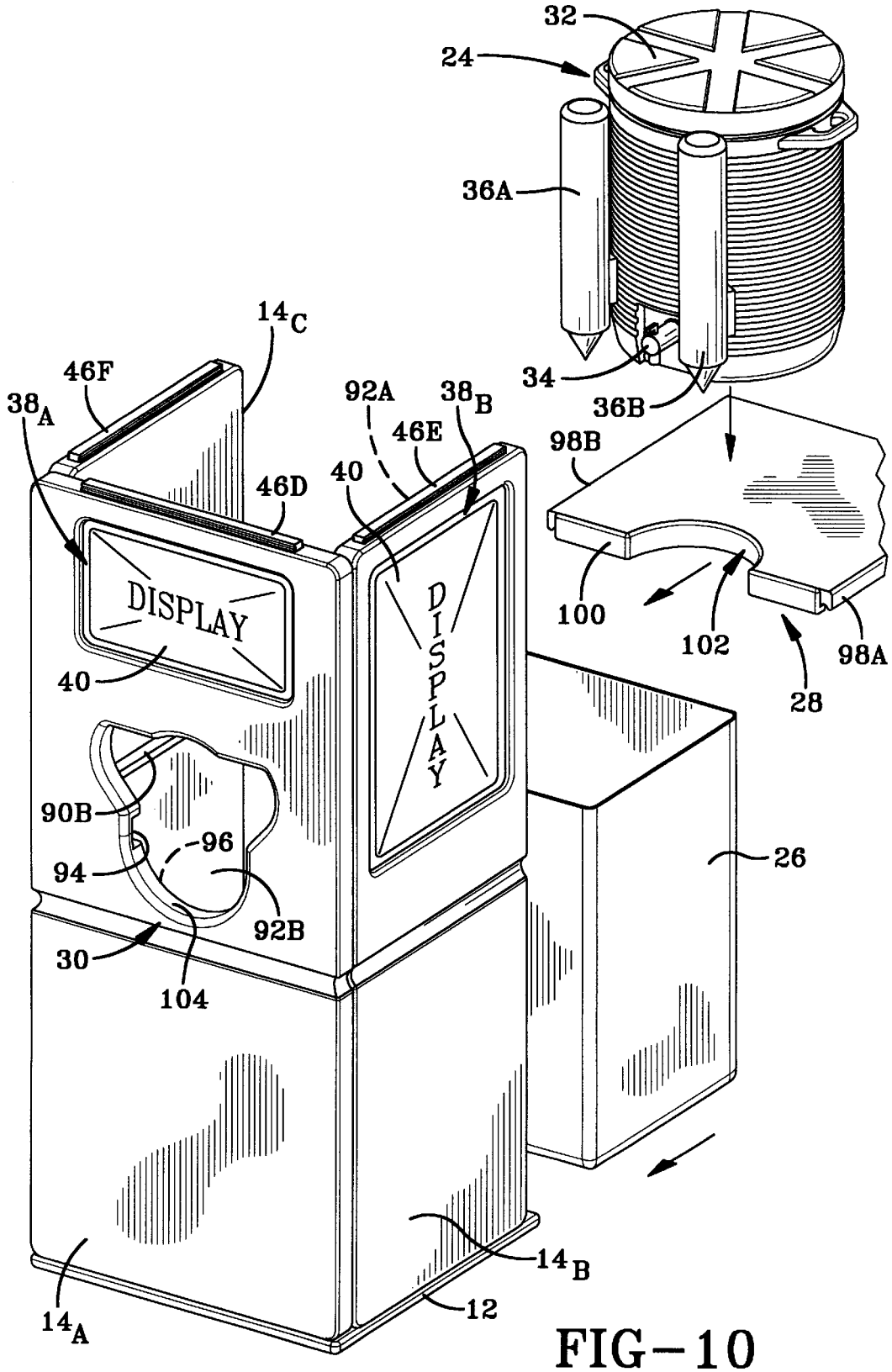
Figure 11:
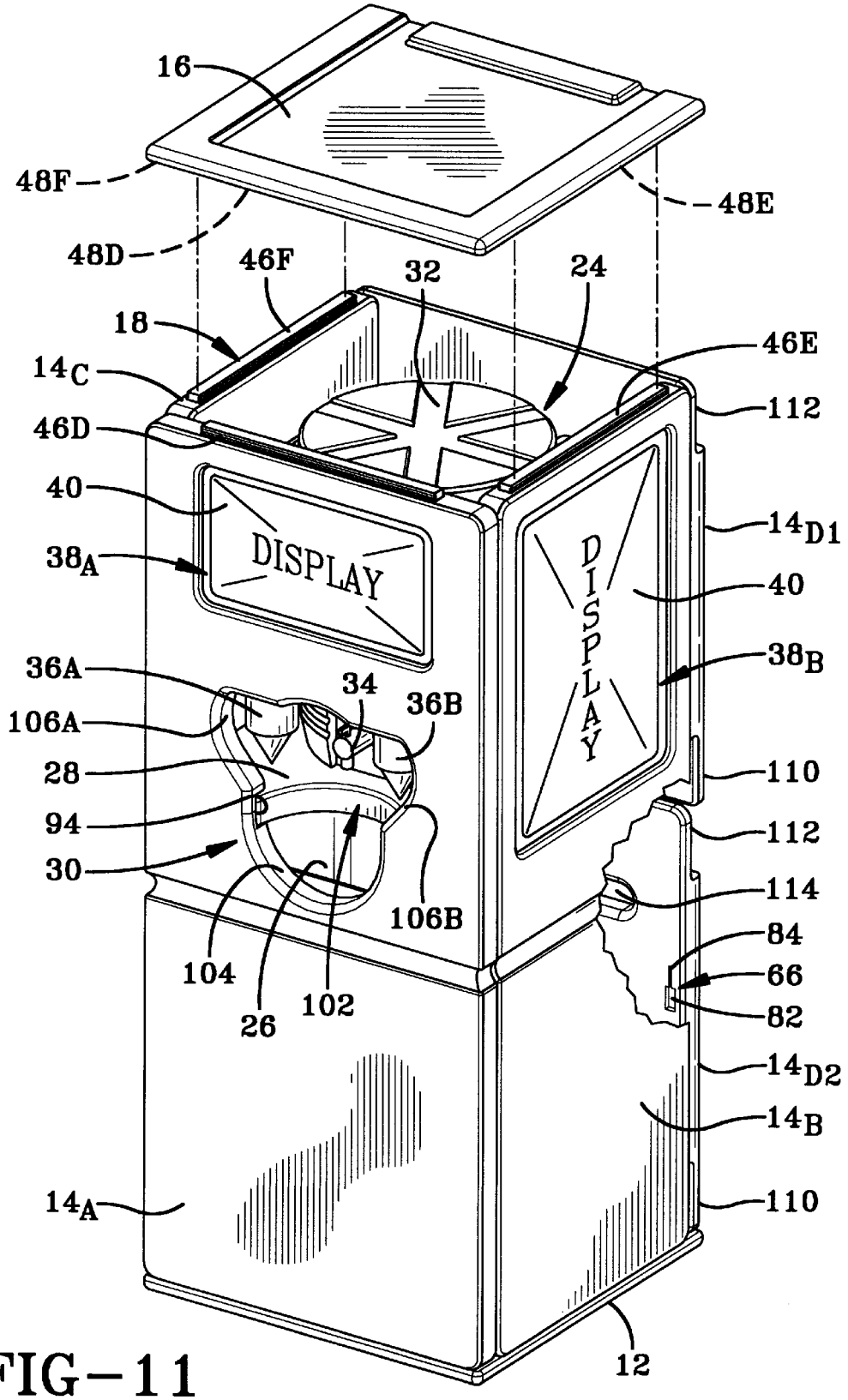

FIG. $9A_1$ is an enlarged, exploded perspective view taken substantially within that area defined by the chain-line circle designated as "9A" on FIG. 8 and depicting the aligning phase of the second interlocking structure—i.e.: a T-lug on the side frame member is aligned with the entry portion of a keyhole recess on the frontal frame member;

FIG. $9A_2$ is a view similar to FIG. $9A_1$ in that it depicts the alignment phase of the second interlocking structure but being an enlarged section through a keyhole recess in the frontal frame member with the T-lug on the side frame member being depicted in side elevation;

FIG. $9B_1$ is an enlarged perspective view similar to FIG. $9A_1$ but depicting the engaging phase of the second interlocking structure—i.e.: the T-lug has been appropriately inserted into the entry portion of the keyhole recess;

FIG. $9B_2$ is a view similar to FIG. $9B_1$, but depicting the engaging phase of the second interlocking structure in partial vertical section and partial side elevation;

FIG. $9C_1$ is an enlarged perspective view similar to FIGS. $9A_1$ and $9B_1$ but depicting the securing phase of the second interlocking means—i.e.: the T-lug has been translated to engage the retention portion of the keyhole recess;

FIG. $9C_2$ is a view similar to FIG. $9C_1$, but depicting the securing phase of the second interlocking structure in partial vertical section and partial side elevation;

FIG. 10 is a partially exploded perspective view depicting that step in effecting assembly of the kiosk following the assembly of the side frame members to the frontal frame member and the base member—i.e.: the medial shelf, the refreshment dispenser and the trash receptacle are aligned for insertion into the partially assembled kiosk;

FIG. 11 is a perspective view similar to FIG. 1, but partially exploded and partially broken away to depict the final steps in the assembly of the kiosk—i.e.: the rear frame members have been secured in place and the top member is aligned for assembly with the reminder of the kiosk by first interlocking means.

DESCRIPTION OF AN EXEMPLARY EMBODIMENT

One representative form of multi-functional kiosk embodying the concepts of the present invention is designated generally by the numeral 10 on the accompanying drawings. The representative multi-functional kiosk 10 preferably has a polygonal base 12 to which a plurality of frame members 14 may be demountably secured, and a roof member 16 may also be demountably secured to the frame members 14. As such the exterior of the kiosk constitutes a polyhedron. The preferred configuration of the kiosk 10 is a parallelepiped—i.e.: a six-faced polyhedron all of whose faces are parallelograms with opposed faces lying in parallel planes. However, it should be understood that the concepts of the invention are as readily applied to virtually any polyhedron. Hence, the base 12 may be a square member to which a frontal frame member $\mathbf{14}_A$, two side frame members $\mathbf{14}_B$ and $\mathbf{14}_C$ and one of two vertically stacked rear frame members $\mathbf{14}_D$ are operatively connected. The roof member 16 may comprise a mirror image of the base 12.

As may be appreciated from the preceding paragraph, closely related, but different, structural members, components or arrangements will generally be identified by a common numerical designation applied to identify such members, components or arrangements, but the individual variations shall be identified by a letter, and/or alphanumeric, subscript used in combination with the number. Thus, the frame members are generally identified by the number 14, but the individual, different, but closely related, front and side frame members are identified with the alphanumeric designations $\mathbf{14}_A$, $\mathbf{14}_B$, $\mathbf{14}_C$, respectively, and the rear frame member sub-portions are designated as $\mathbf{14}_{D1}$ and $\mathbf{14}_{D2}$. This convention shall be employed throughout the specification.

Selected frame members 14 may be demountably secured to the base member 12 by a first interlocking structure 18 (FIGS. 7A and 7B), and the frame members 14 may be demountably secured to each other by a second interlocking structure 20 (detailed in FIGS. $9A_1$ through $9C_2$). Selected frame members 14 may also be demountable secured to the roof member 16 by a first interlocking structure 18.

Figure 2:
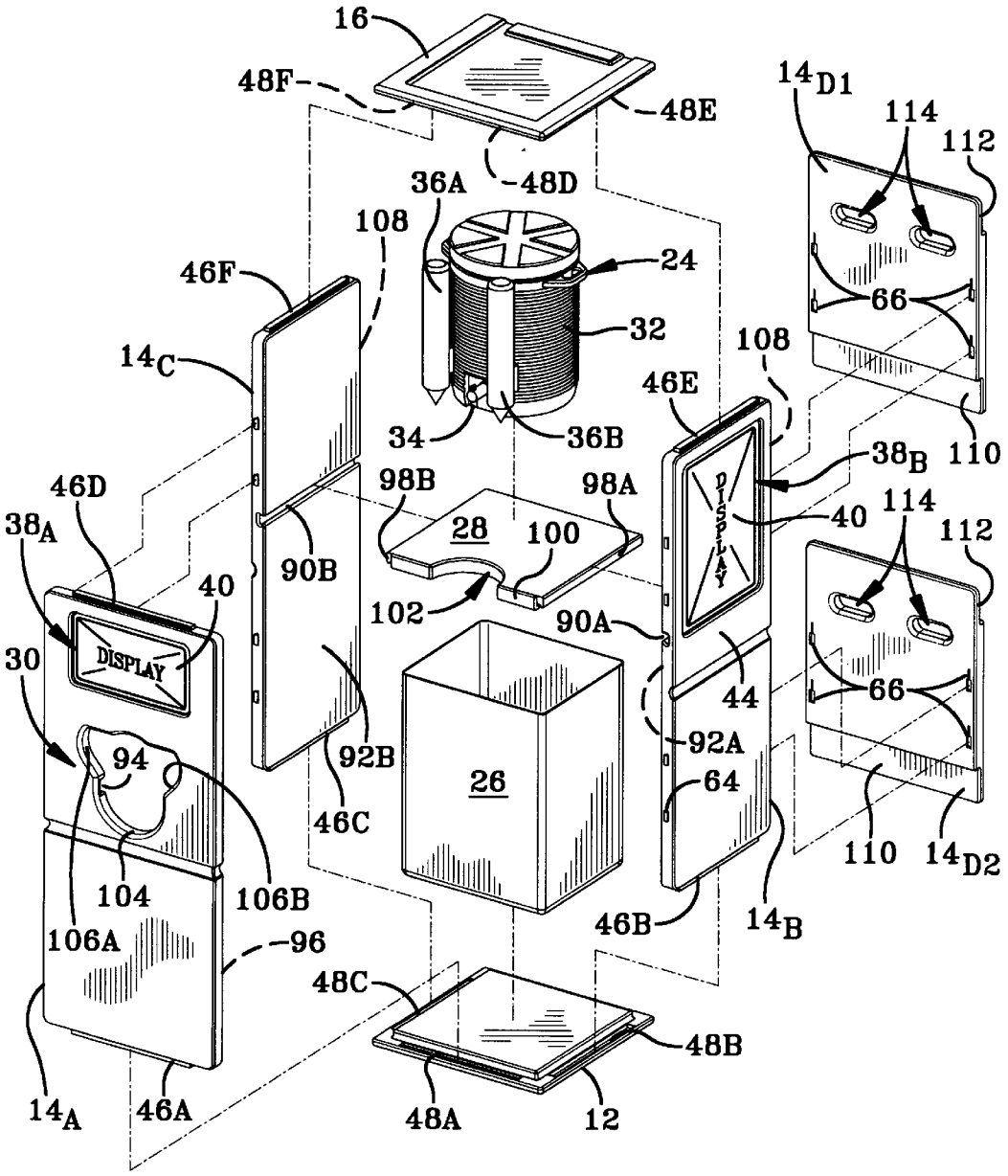
FIG. 2 is an exploded perspective of the kiosk depicted in FIG. 1, but of reduced size and including the depiction of a refreshment dispenser and the medial shelf on which the refreshment dispenser may be supported as well as a trash-receiving receptacle disposed beneath the medial shelf.
Figure 3:
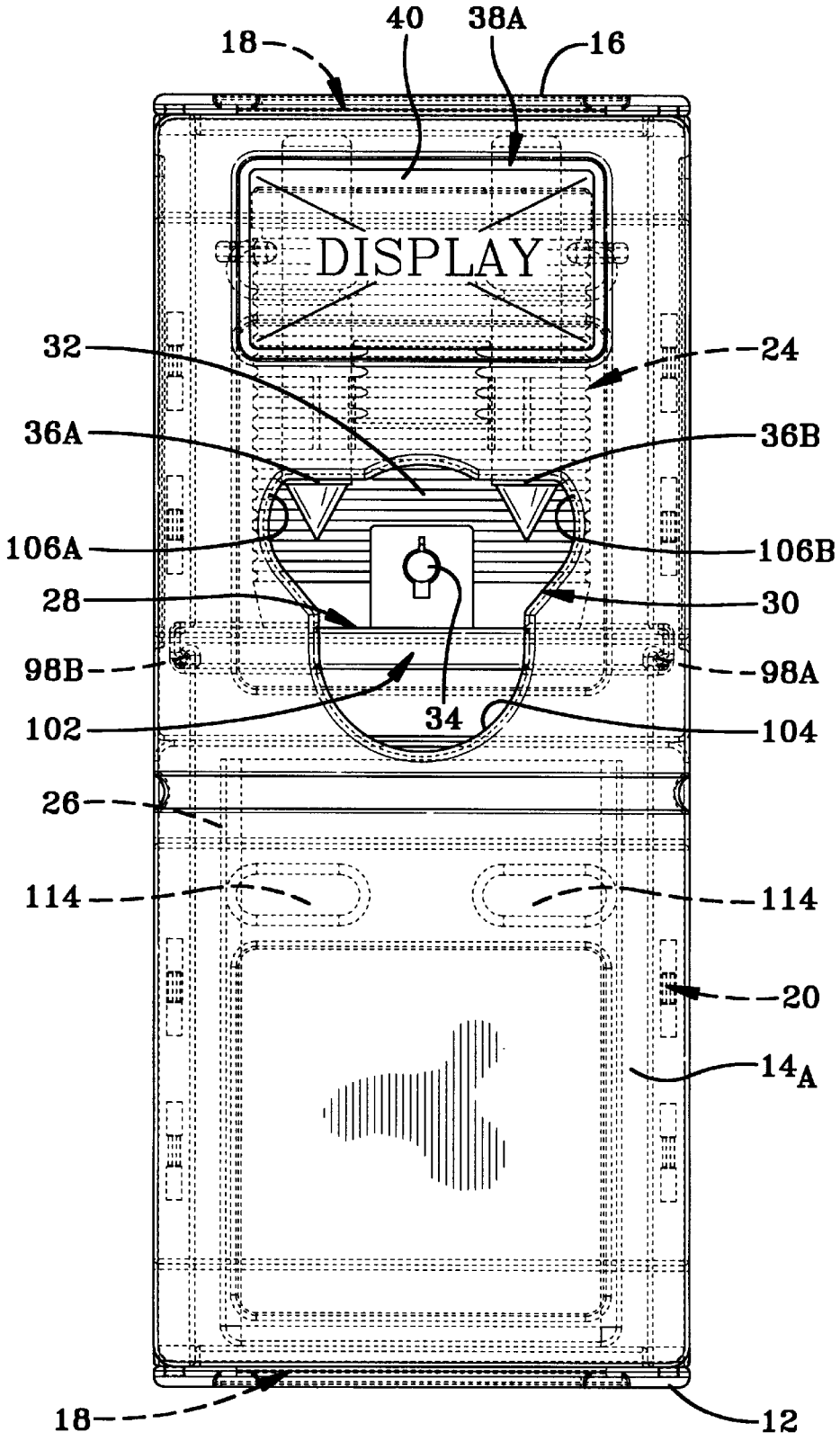
FIG. 3 is a frontal elevation of a kiosk embodying the concepts of the present invention.
Figure 4:
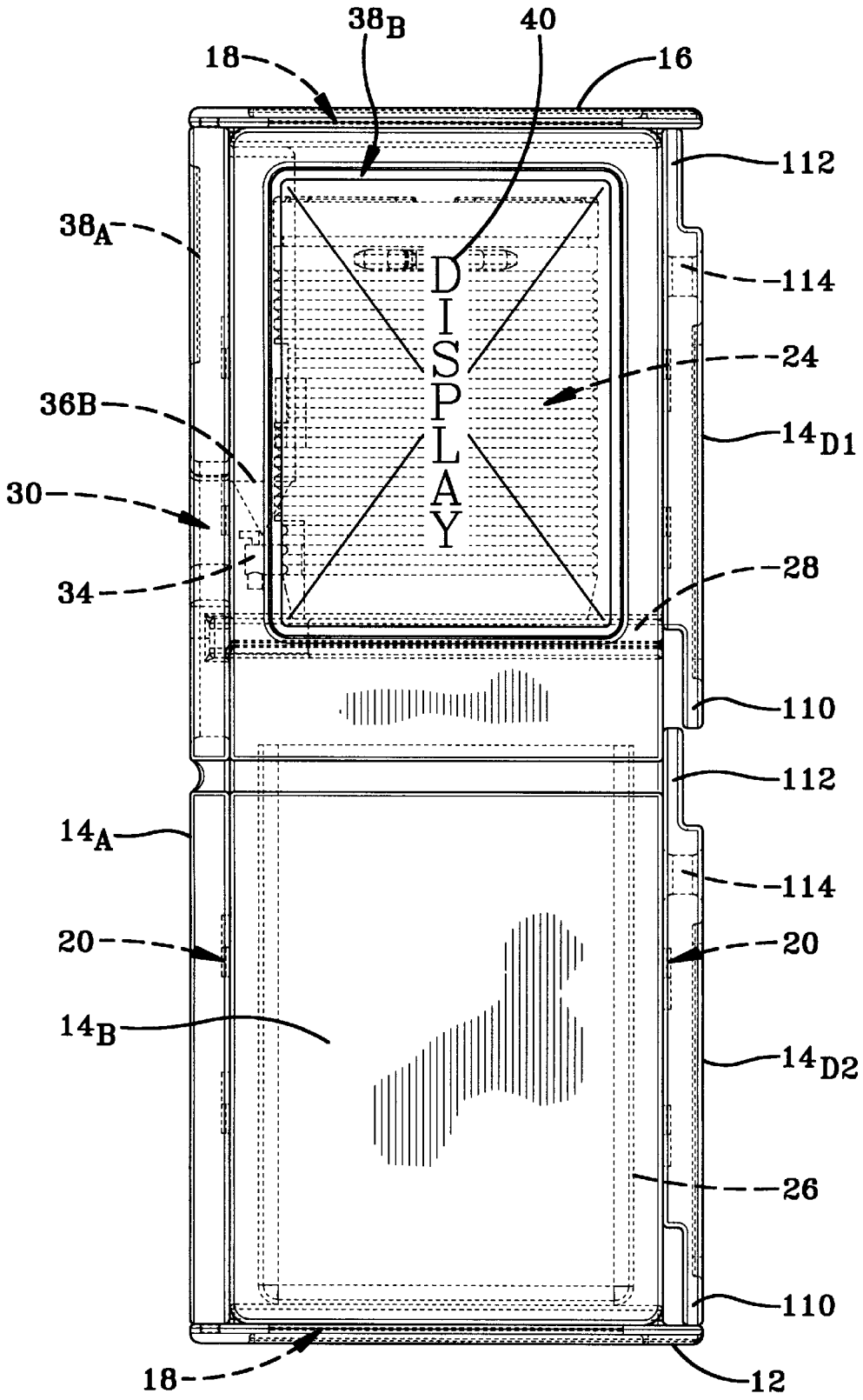
FIG. 4 is a side elevation of a kiosk embodying the concepts of the present invention.
Figure 5:
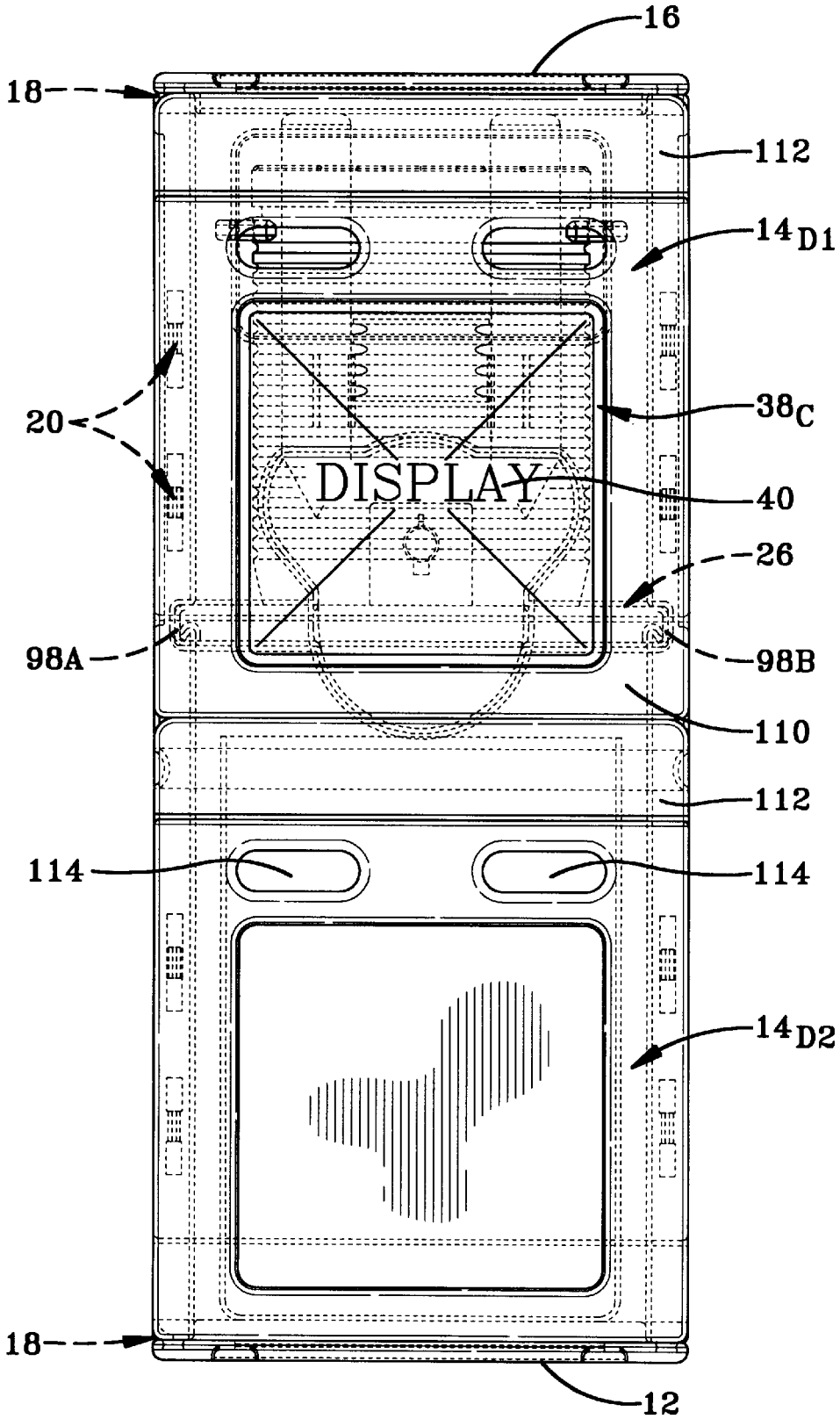
FIG. 5 is a rear elevation of a kiosk embodying the concepts of the present invention.

When assembled, the frame members 14 define a hollow, central cavity 22 within which a refreshment dispenser 24 as well as a trash receptacle 26 may be supported. The refreshment dispenser 24 is supported on a medial shelf 28 that may be supported, as will be hereinafter more fully described, by interactive engagement with the side frame members $\mathbf{14}_B$ and $\mathbf{14}_C$ as well as with the frontal frame member $\mathbf{14}_A$. At least one frame member 14 may be penetrated by an aperture 30 to permit facile access to both the refreshment dispenser 24 and the trash receptacle 26. As best seen in FIG. 2, the refreshment dispenser 24 may comprise a tank 32 with a customary spigot 34, and a pair of cup holders 36A and 36B may be mounted on the tank 32, one on either side of the spigot 34.

As may be appreciated from the preceding paragraph, in the detailed description which follows a particular structural member, component or arrangement may be employed at more than one location. When referring generally to that type of structural member, component or arrangement a common numerical designation shall be employed. However, when one of the structural members, components or arrangements so designated is to be individually identified it shall be referenced by virtue of a letter suffix employed in combination with the numerical designation employed for general identification of that structural member, component or arrangement. Thus, there are two cupholders which are generally identified by the numeral 36, but the specific, individual cupholders are, therefore, identified as 36A and 36B in the specification and on the drawings. This same suffix convention shall also be employed throughout the specification.

Panel portions 38 are provided on the exterior of selected frame members 14 to present advertising displays 40. In the embodiment depicted, the kiosk 10 has a frontal frame member $\mathbf{14}_A$, two side frame members $\mathbf{14}_B$ and $\mathbf{14}_C$ and a rear frame member $\mathbf{14}_D$ which may be separated into an upper half $\mathbf{14}_{D1}$ and a lower half $\mathbf{14}_{D2}$ to facilitate individually replacing of the refreshment dispenser 24 and emptying the trash receptacle 26. Inasmuch as the frontal frame member $\mathbf{14}_A$ is penetrated by an access aperture 30, the advertising panel portion $\mathbf{38}_A$ on the frontal frame member $\mathbf{14}_A$ will necessarily be of reduced size. On the other hand the side frame members $\mathbf{14}_B$ and $\mathbf{14}_C$ may each present advertising panel portions $\mathbf{38}_B$ that cover a significant portion of at least the upper half of those frame members. Similarly, the upper half $\mathbf{14}_{D1}$ of the rear frame member $\mathbf{14}_D$ my also be provided with a panel portion $\mathbf{38}_C$ that covers a significant portion of its surface area.

It must be understood that a greater or lesser number of panel portions 38 may be provided. Advertisers may wish to restrict the number of other advertisements appearing on any view of the kiosk 10, and the arrangement depicted was selected merely to be representative of what can be readily accomplished. In any event, the advertising displays 40 may be permanently applied to the panel portions 38, as by a silk screen process, or the advertising displays may be removably mounted in the panel portions 38. In those situations where the kiosk 10 will be used only for a short time interval—say a week or less—the advertising displays may be secured to the panel portions 38 as by two-sided masking tape 42 (FIG. 8). Virtually any means for securing the advertising displays 40 may be employed and still fall within the scope of the present invention. The panel portions 38 may lie within the plane of the exterior surface 44 of the corresponding frame member 14, or, as shown, the panel portions 38 may be recessed with respect to the exterior surface 44 in order to provide at least a modicum of protection to the surface of the advertising display 40 applied to the recessed panel portion 38.

Various interlocking devices may be employed to secure the frame members 14 to each other as well as to the base 12 so long as they permit the kiosk to be readily disassembled for transportation and storage and yet provide structural integrity when assembled for use. Even so, the following discussion regarding assembly of the kiosk 10 will focus on two preferred forms of first and second interlocking structures 18 and 20, respectively.

Figure 6:
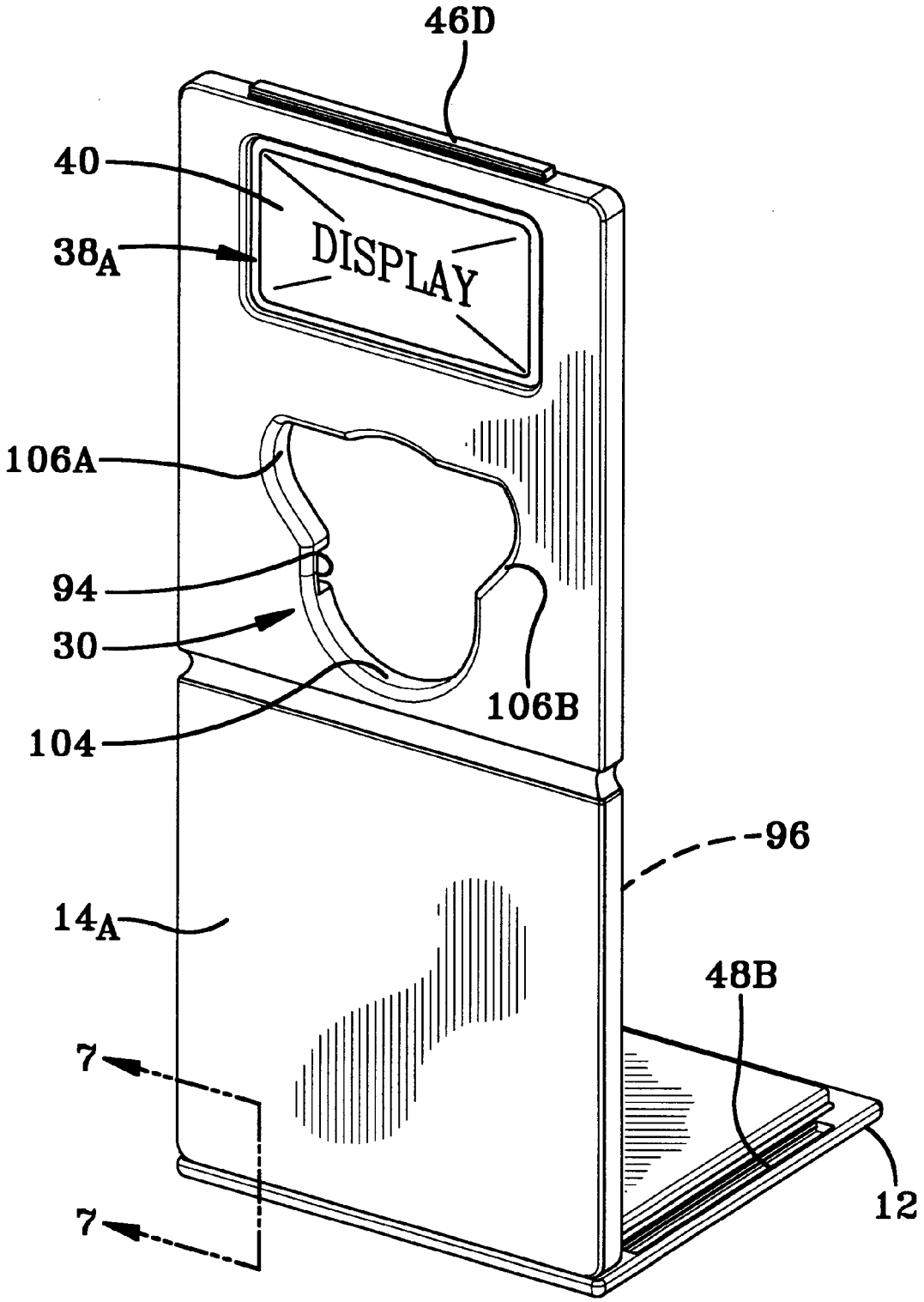
FIG. 6 is a perspective view depicting the first step in effecting assembly of the kiosk—i.e.: the frontal frame member has been secured to the polygonal base member.
Figure 7A:
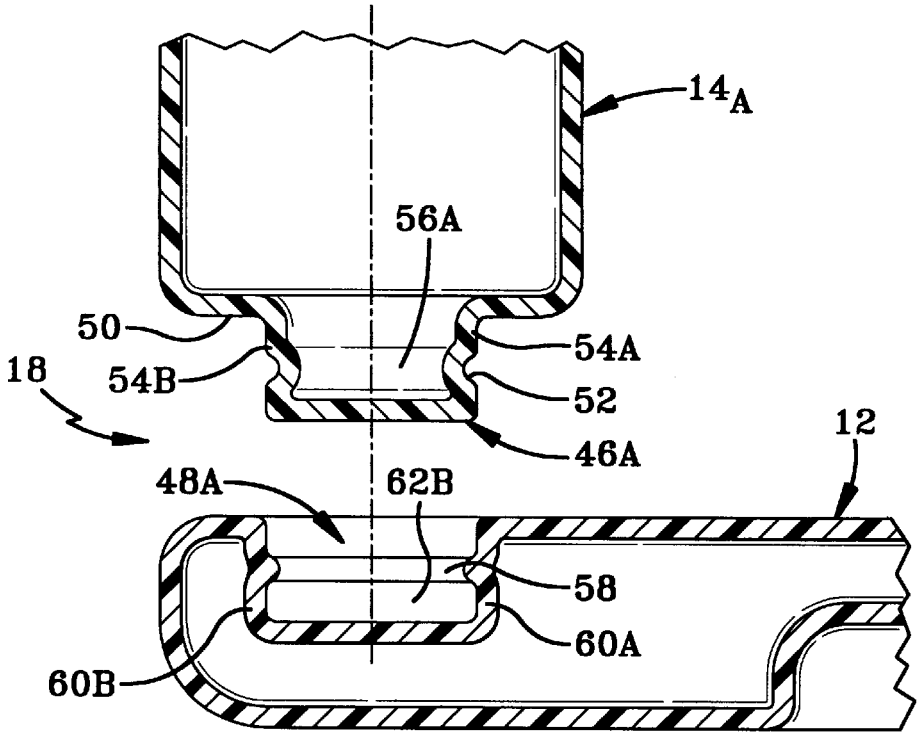
FIG. 7A is an enlarged, exploded, cross sectional view taken substantially along line 7—7 of FIG. 6 to depict the aligning phase of a first interlocking means—i.e.: the alignment of a tenon on the frontal frame member with a corresponding mortise in the polygonal base member.
Figure 7B:
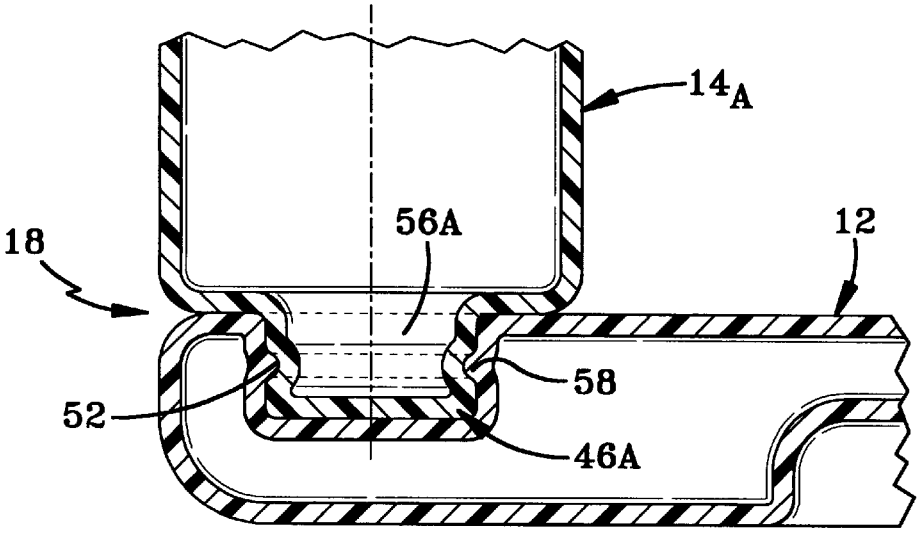
FIG. 7B is a view similar to FIG. 7A but depicting the engaging phase of the first interlocking structure—i.e.: with the tenon received within the mortise—as well as the securing phase of the first interlocking structure—i.e.: the engagement of a detent means operatively interposed between the mortise and tenon.

The first step in effecting assembly the kiosk 10, is to secure a frontal frame member $\mathbf{14}_A$ to the base 12, as is best represented in FIG. 6, and this can be readily accomplished by the use of a first interlocking structure 18 (FIGS. 7A and 7B) that comprises a tenon 46A that is receivable within a mortise 48A. Although the placement of the tenon 46 and the inter-fitting mortise 48 may be reversed, as best represented in FIGS. 7A and 7B the tenon 46A extends downwardly from the lower edge 50 of the frontal frame member $\mathbf{14}_A$ and is preferably disposed within the plane of the frame member $\mathbf{14}_A$ from which it extends. To facilitate storage of the disassembled kiosk components and at the same time minimize potential damage to the interlocking structures, it is preferred that those structural elements of the interlocking structures which protrude are disposed to lie within the plane of the structural member from which they protrude.

Accordingly, an appropriate mortise 48A is provided within the base 12 to receive the tenon 46A. As depicted in FIG. 7A, the tenon 46A is aligned with the mortise 48A in what is designated as the "aligning phase" in the operation of the first interlocking structure 18. By translating the frontal frame member $\mathbf{14}_A$ downwardly, the tenon 46A is insertably received within the mortise 48A. When the tenon 46A is insertably received within the mortise 48A—as represented in FIG. 7B—the first interlocking structure 18 is disposed in what is designated as the "engaging phase." For the first interlocking structure 18 the engaging phase may also be the "securing phase." To the contrary, and as will be hereinafter more fully explained, in the second interlocking structure 20 the engaging and securing phases may be quite distinct.

To expand upon the structure which effects the coincidence of the engaging and securing phases of the first interlocking structure 18, and with particular attention to FIG. 7A, the tenon 46 is provided with a semi-circular detent recess 52 that may extend along not only the full length of the laterally spaced side walls 54A and 54B of the tenon 46 but also along the transversely extending end walls (only end wall 56A is depicted) of the tenon 46A.

With continued reference to FIG. 6A, the blind mortise 48A—"blind" in that the mortise does not fully penetrate the base 12—presents a semi-circular detent dog 58 that may extend along not only the full length of the laterally spaced side walls 60A and 60B of the mortise 48 but also along the transversely extending end walls (only end wall 62A is depicted) of the mortise 48A. By making the kiosk from a resilient material that is at least modestly elastic, the semi-circular detent dog 58 can be snapped into the detent recess 52 upon insertion of the tenon 46 into the mortise 48. Conversely, by utilizing a conforming, semi-circular configuration for the detent recess 52, the engaging curvilinear surface of the detent recess 52 will force the detent dog 58 to retract upon the application of a reasonable force applied to withdraw the tenon 46 from the mortise 48.

At this point it should be noted that suitable polymeric materials for the manufacture of the frame members 14, the base 12 and the roof member 16 of the kiosk 10 may be thermoplastics that are both resilient and have high impact resistance. Such thermoplastics include polyolefins, such as polypropylene and high density polyethylene and rubber modified polyolefins, as well as blends and mixtures thereof. In the preferred embodiment, the members will be made of polypropylene. The foregoing list is not to be construed as limiting but is rather merely exemplary of suitable polymer materials.

The second step in effecting assembly the kiosk 10, is to secure a side frame member, say member $\mathbf{14}_B$, to the frontal frame member $\mathbf{14}_A$ as well as to the base 12, as depicted in FIG. 8. The selected side frame member $\mathbf{14}_B$ is secured to the frontal frame member $\mathbf{14}_A$ by virtue of the second interlocking structure 20. Before describing the actual connecting sequence, it should be understood that the second interlocking structure 20 preferably comprises a T-lug 64 that is operatively receivable within a keyhole slot 66, as best represented in the various FIGS. 9.

With specific reference to FIGS. $\mathbf{9A}_1$ and $\mathbf{9A}_2$—one or more T-lugs 64 extend outwardly—and thus forwardly—from the vertically oriented edge 68 of the side member $\mathbf{14}_B$ operatively to engage a like number of keyhole slots 66 provided in the rear wall 70 of the frontal frame member $\mathbf{14}_A$. The keyhole slot 66 may simply penetrate the rear wall 70, or, for greater strength, the keyhole slot 66 may penetrate that portion of the rear wall 70 which overlies a recess 72 disposed between the rear wall 70 and a backing wall 74, as best represented in FIG. $\mathbf{9A}_2$. The backing wall 74 may be disposed forwardly of the rear wall 70 and lie in spaced, parallel relation to the rear wall 70. As shown, the backing wall 74 may be integrally connected to the rear wall 70, as by an offsetting perimeter wall 76. If a backing wall 74 is employed, it must be spaced sufficiently forwardly of the rear wall 74 to accommodate the hereinafter described head portion 80 of the T-lug 64.

With continued reference to FIGS. $\mathbf{9A}_1$ and $\mathbf{9A}_2$, it can be readily observed that each T-lug 64 includes a shank portion 78 that extends outwardly from the vertically oriented edge 68 of the side frame member $\mathbf{14}_B$ to terminate in the head portion 80. Although the head and shank portions 80 and 78, respectively, may have the same vertical dimension "A", the transverse dimension "B" of the head portion 80 exceeds the transverse dimension "C" of the shank portion 78. The front-to-rear dimension "D" of the head portion 80 must, as mentioned, be less than the corresponding dimension "E" of the recess 72. The front-to-rear dimension "F" of the shank portion 78 is preferably comparable to the thickness "G" of the rear all 70 in order for the second interlocking structure 20 to provide a firm connection between the frontal frame member $\mathbf{14}_A$ and the side frame member $\mathbf{14}_B$.

The keyhole slot 66 has an entry portion 82 and a retention portion 84 which penetrate the rear wall 70 of the frontal frame member $14_A$ to provide access to the recess 72. The entry portion 82 has both a transverse dimension "H" and a vertical dimension "J" that are slightly in excess of corresponding dimensions "B" and "A," respectively, to receive the head portion 80 of a T-lug 64. The retention portion 84 has lateral sides 86A and 86B defined as the facing surfaces presented from a pair of opposed retention flanges 88A and 88B. The lateral sides 86A and 86B are separated by a distance "K" which is slightly in excess of dimension "C" in order to permit the shank portion 78 of the T-lug 64 to be received therebetween. The dimension "K" precludes the passage of the head portion 80 therethrough inasmuch as the transverse dimension "B" of the head portion 80 significantly exceeds the transverse distance "K" between the lateral surfaces which bound the retention portion 84 of the keyhole slot 86.

With the first and second interlocking structures having been described, securing the side frame member to the frontal frame member $14_A$ as well as to the base 12, is accomplished by first accomplishing the aligning phase of the second interlocking structure 20, as depicted in FIGS. $9A_1$ and $9A_2$. From that position, translation of the side frame member $14_B$ forwardly brings the second interlocking structure 20 into the engaging phase depicted in FIGS. $9B_1$ and $9B_2$. No interference between the components of the first interlocking structure 18 is occasioned by thus translating the side frame member $14_B$ inasmuch as the components of the first interlocking structure are dimensioned to preclude any such interference. When the structural components of the second interlocking structure 20 are disposed in the engaging phase depicted in FIG. $9B_1$ and $9B_2$, the components of the first interlocking structure 18 are disposed in the aligning phase represented in FIG. 7A.

Hence, downward translation of the side frame member $14_B$ when the second interlocking structure is in the engaging phase (FIGS. $9B_1$ and $9B_2$) will effect transition of the second interlocking structure 20 from the engaging phase to the securing phase (FIGS. $9C_1$ and $9C_2$) while simultaneously effecting transition of the first interlocking structure from the aligning phase (FIG. 7A) to the combined engaging and securing phase (FIG. 7B).

Side frame member $14_C$ can be similarly manipulated to effect the desired connection of that side frame member to both the frontal frame member $14_A$ and the base member 12. After the side frame member $14_C$ has thus been added to the assemblage, the resulting, partially assembled kiosk will have acquired the appearance of the partially assembled kiosk depicted in FIG. 10.

With the frontal frame member $14_A$ and the two side frame members $14_B$ and $14_C$ connected to each other as well as to the base member 12, the partially assembled kiosk will have acquired considerable stability, and the medial shelf 28 can be added. As can best be observed from FIG. 2, a horizontal slot 90A is provided on the interior face 92A of side frame member $14_B$, and an opposed horizontal slot 90B is similarly provided on the interior face 92B of side frame member $14_C$. When the side frame members $14_B$ and $14_C$ are joined to the frontal frame member $14_A$ and all three are joined to the base member 12, the horizontal slots 90 in the side frame members $14_B$ and $14_C$ align with a horizontal slot 94 that extends transversely across the interior face 96 of the frontal frame member $14_A$. The lateral edges 98A and 98B of the medial shelf 28 are received within the opposed slots 90A and 90B, respectively, and the forward edge 100 of the medial shelf 28 is received within the slot 94. The engagement of the medial shelf 28 with three slots 90A, 90B and 94 provides the support necessary for the shelf 28 readily to bear the weight of the refreshment dispenser 24. At this point it should be observed that in order to obviate any possible outward bowing of the side frame members $14_B$ and $14_C$ as well as any downward bowing of the medial shelf 28 which might tend to disengage the lateral edges 98A and 98B from the opposed slots 90A and 90B under the weight of the refreshment dispenser 24, the lateral edges 98 of the medial shelf 28 and the horizontal slots 90 may be at least partially dove-tailed to preclude lateral withdrawal of the lateral edges 98, either in whole or in part, from the horizontal slots 90, thereby securing the side frame members $14_B$ and $14_C$ against outward bowing. Reference to FIG. 10 reveals a half dove-tail configuration to the lateral edges 98.

It should also be observed that the forward edge 100 of the medial shelf is interrupted by a semi-circular recess 102 which provides access through which a user may deposit used cups, or other waste material, into the trash container 26 that can also be inserted within the central cavity 22 delineated by the partially assembled kiosk, as is also represented in FIG. 10. Access to the semi-circular recess 102, and the trash-receiving receptacle 26, is provided by the lowermost, circular lobe 104 of the access aperture 30. For convenience, and also pleasantly to enhance the geometrical appearance of the access aperture 30, a pair of opposed wing-like lobes 106A and 106B may extend the lateral dimension of the access aperture 30 to enable the user to access the laterally disposed cup holders 36A and 36B as readily as one can access the centrally located spigot 34. As their name implies, the wing-like lobes 106 may have a linear upper edge that merges with a curvilinear lower edge.

As previously noted, the rear frame member $14_D$ is preferably divided into upper and lower halves $14_{D1}$ and $14_{D2}$, respectively. It must also be remembered that it is preferable for the protruding portions of the interlocking structures to be confined to the plane of the member from which they protrude. Hence, the second interlocking structure 20 utilized to secure the rear frame members $14_D$ to the side frame members $14_B$ and $14_C$ have the T-lugs 64 mounted on the rear edges 108A and 108B, respectively, of the side frame members $14_B$ and $14_C$. As such, and because it is desirable to have the rear frame members individually mounted by downward displacement thereof with respect to the side frame members $14_B$ and $14_C$, it will be observed that the keyhole slots 66 utilized on the rear frame members $14_D$ are inverted, as is perhaps best seen in FIG. 11.

The inversion of the keyhole slots 66 in the rear frame members $14_D$ and the desire to permit the trash-receiving container 26 to be emptied without accessing the refreshment dispenser, and at the same time to reduce the potential for the admission of rainwater, it is highly desirable to have the lower edge 110 of the upper rear frame member $14_{D1}$ overlie a portion of the upper edge 112 on the lower frame member $14_{D2}$. This is preferably accomplished by providing rabbeted edges so that the rear exterior surfaces of the upper and lower rear frame members $14_{D1}$ and $14_{D2}$ lie within a common plane and yet the rabbeted edges 110 and 112 are offset to permit relative vertical movement between the upper and lower rear frame members without interference. In fact, the upper and lower rear frame members $14_{D1}$ and $14_{D2}$ can be identically formed so that the upper and lower edges on each presents a laterally extending rabbet. Because the rabbeted upper edge 112 on the upper frame member $14_{D1}$ permits the roof member 16 to overhang the upper rear frame member $14_{D1}$, it is less likely that water will be able to drip off the roof member 16 and makes its way into the trash receptacle 26.

Because of the rabbeted edges, one may vertically translate each of the rear frame members independently of the other rear frame member. As such, one may raise the lower frame member $14_{D2}$ to release the second interlocking structure 20 and then swing the lower edge of the lower frame member outwardly to disengage the components of the second interlocking structure 20 in order to remove the lower rear frame member independently of the upper rear frame member $14_{D1}$. This permits the trash-receiving receptacle 26 to be emptied and replaced independently of the refreshment dispenser 24.

The rear frame members $14_D$ are also preferably provided with a pair of hand holes 114 to facilitate manipulation of the rear frame members.

It has, however, been deemed desirable not to permit such ready access to the refreshment dispenser. As such, the upper rear frame member $14_{D1}$ is not designed to be removed unless the roof member 16 has been disengaged from the other frame members. That is, the first interlocking structures 18 by which the roof member 16 is secured to the frontal frame member $14_A$ and the two side frame members $14_B$ and $14_C$ must first be disengaged and the roof member 16 removed before the upper rear frame member $14_{D1}$ can be removed from the assembled kiosk 10.

The first interlocking structures 18 operative between the roof member 16 and the frame members 14 comprise one or more tenon 46D extending upwardly within the plane of the frontal frame member $14_A$ to engage a mortise 48D in the roof member 16. Similar tenons 46E and 46F are provided within the plane of the respective side frame members $14_B$ and $14_C$ to engage mortises 48E and 48F in the roof member 16. There is no interlocking structure employed between the rear frame member $14_D$ and either the base 12 or the roof member 16.

While only a preferred embodiment of our present invention is disclosed, it is to be clearly understood that the same is susceptible to numerous changes apparent to one skilled in the art. Therefore, the scope of the present invention is not to be limited to the details shown and described but is intended to include all changes and modifications which come within the scope of the appended claims.

As should now be apparent, the present invention teaches that a multi-functional kiosk embodying the concepts of the present invention is fully capable of accomplishing the objects of the invention.

We claim:

1. A collapsible, multi-functional kiosk comprising:

a polygonal base member;

a plurality of frame members;

first interlocking means releasably secure selective said frame members to said polygonal base member;

said first interlocking means utilizes a member protruding from one of said selectively connected frame members and disposed within a plane of said frame members from which said member protrudes;

said first interlocking means also utilizes a recess in said frame member within which said protruding member of said first interlocking structure is receivable;

second interlocking means releasably secure said frame members to each other;

said second interlocking means also utilizes a member protruding outwardly from said selected frame member and within a plane of said frame members from which it protrudes;

said second interlocking means also utilizes a recess in said base and roof members with which said protruding member of said second interlocking means is receivable;

a tenon protruding from said selected frame members in each of said first interlocking means;

a T-lug protruding from said selected frame members in each of said second interlocking means;

one or more mortises provided in said base and roof members in each of said first interlocking means associated with said base and roof members;

a keyhole recess provided in selected frame members to be engaged by said T-lugs in each said second interlocking means;

a hollow, central cavity defined a connection of said frame members to each other as well as by the connection of said frame members to said polygonal base;

a refreshment dispenser being supported within said hollow, central cavity;

a trash receptacle also being supported within said hollow, central cavity;

an aperture penetrating at least one of said frame members to provide access to said refreshment dispenser and said trash receptacle;

panel portions provided on an exterior of selected frame members to present advertising displays; and, one of said roof members releasably secured to said selected frame members.

2. The collapsible, multi-functional kiosk, as set forth in claim 1, wherein said first and second interlocking means utilize:

an aligning phase;

an engaging phase; and, a securing phase.

3. The collapsible, multi-functional kiosk, as set forth in claims 2, wherein:

said second interlocking means is in said engaging phase when said first interlocking means is in said aligning phase; and, said second interlocking means is in said securing phase when said first interlocking means is in said engaging phase.

4. The collapsible, multi-functional kiosk, as set forth in claim 3, wherein:

said engaging and retaining phases of said first interlocking means are structurally identical; and, said engaging and retaining phases of said second interlocking means are structurally distinct.

5. The collapsible, multi-functional kiosk, as set forth in claim 1, wherein said second interlocking means further comprise:

a head portion and a shank portion on each of said T-lugs;

an entry portion and a retaining portion in each said keyhole recess;

said head portion on said T-lug being receivable through said entry portion of said keyhole recess;

a shaft portion being receivable through said retaining portion and said head portion being positionable behind said retaining portion when said shaft portion is received in said retaining portion;

said head portion being of a larger dimension than said retaining portion to preclude passage of said head portion through said retaining portion.

6. The collapsible, multi-functional kiosk, as set forth in claim 5, wherein:

said frame member which incorporates said keyhole recess is maintained substantially fixed; and, said frame member which incorporates said T-lug is translated downwardly to affect an operative connection of said second interlocking structure.

7. A collapsible, multi-functional kiosk comprising:

a polygonal base member;

a plurality of frame members;

first interlocking means releasably secure selective said frame members to said polygonal base member wherein said first interlocking means utilizes a member protruding from one of said selectively connected frame members and disposed within a plane of said frame members from which said member protrudes;

said first interlocking means also utilizes a recess in said frame member within which said protruding member of said first interlocking structure is receivable;

second interlocking means releasably secure said frame members to each other, wherein said second interlocking means also utilizes a member protruding outwardly from said selected frame member and within a plane of said frame members from which it protrudes;

said second interlocking means utilizes a recess in said base and roof members with which said protruding member of said second interlocking means is receivable;

a rear frame member contiguous to two side frame members;

said rear frame member having separate upper and lower portions;

said second interlocking means being employed to releasably secure each of said upper and lower portions of said rear frame member to said contiguous side frame members;

T-lug members protruding from each of said side frame members within a plane of said side frame members; and, corresponding keyhole recesses in said rear frame member portions within which said protruding T-lugs are receivable;

a hollow, central cavity defined by a connection of said frame members to each other as well as by the connection of said frame members to said polygonal base;

a refreshment dispenser being supported within said hollow, central cavity;

a trash receptacle also being supported within said hollow, central cavity;

an aperture penetrating at least one of said frame members to provide access to said refreshment dispenser and said trash receptacle;

panel portions provided on an exterior of selected frame members to present advertising displays; and, a roof member releasably secured to said selected frame members.

8. The collapsible, multi-functional kiosk, as set forth in claim 7, wherein said keyhole recesses in said rear frame member portions are inverted.

9. The collapsible, multi-functional kiosk, as set forth in claim 7, further comprising:

rabbeted upper and lower edges on said rear frame member portions; and said rabbeted edges being at least partially overlapped at least during individual assembly and disassembly of said rear frame member portions.

10. The multi-functional kiosk, as set forth in claim 9, further comprising:

a medical shelf member disposed within said hollow, central cavity and supported from said selected side frame members; and said refreshment dispenser supported on said medial shelf member.

11. The multi-functional kiosk, as set forth in claim 10, wherein:

said medial shelf has edges;

said selected side frame members each having a horizontal slot matingly to engage the edges of said medial shelf; and said mating edges and horizontal slots being at least partially dovetailed.

12. The multi-functional kiosk, as set forth in claim 11, further comprising:

a trash-receiving receptacle disposed within said hollow, central cavity beneath said medial shelf; and said medical shelf having a recess to access said trash-receiving receptacle from outside of said kiosk through said aperture.

* * * * *